United States Patent [19]

Frye

[11] Patent Number: 4,525,604

[45] Date of Patent: Jun. 25, 1985

[54] HORN LOUDSPEAKER WITH CONVEX DIAPHRAGM

[75] Inventor: Kent Frye, Buchanan, Mich.

[73] Assignee: Electro-Voice, Incorporated, Buchanan, Mich.

[21] Appl. No.: 502,011

[22] Filed: Jun. 7, 1983

[51] Int. Cl.[3] ..... H04R 9/00; H04R 1/28; H04R 1/30

[52] U.S. Cl. ..... 179/115.5 H; 179/115.5 R; 179/115.5 ES; 181/152; 181/159; 181/177; 181/190

[58] Field of Search ..... 179/115.5 H, 115.5 R, 179/115.5 ES, 115.5 VC, 178, 179, 180; 181/152, 159, 177, 190

[56] References Cited

U.S. PATENT DOCUMENTS

| | | | |
|---|---|---|---|
| 2,037,187 | 4/1936 | Wente | 179/115.5 H |
| 2,873,812 | 2/1959 | Avedon | 181/159 |
| 3,016,430 | 1/1962 | Hoodwin | 179/115.5 H |
| 3,454,729 | 7/1969 | Seebinger | 179/115.5 H |
| 3,672,462 | 6/1972 | Auer, Jr. | 179/115.5 H |
| 4,050,541 | 9/1977 | Henricksen | 179/115.5 H |
| 4,071,112 | 1/1978 | Keele, Jr. . | |

FOREIGN PATENT DOCUMENTS

| | | | |
|---|---|---|---|
| 815978 | 1/1950 | Fed. Rep. of Germany | 179/115.5 H |
| 506290 | 12/1954 | France | 179/115.5 VC |

*Primary Examiner*—Gene Z. Rubinson
*Assistant Examiner*—Danita R. Byrd
*Attorney, Agent, or Firm*—Burmeister, York, Palmatier, Hamby & Jones

[57] ABSTRACT

A horn loudspeaker with a convex diaphragm in which the throat of the horn is formed by an assembly including the diaphragm, a cover plate for the diaphragm, a tapered plug, and a base, the plug and cover forming linear channels of equal length confronting different portions of the convex dome of the diaphragm.

10 Claims, 6 Drawing Figures

HORN LOUDSPEAKER WITH CONVEX DIAPHRAGM

The present invention relates generally to horn loudspeakers, and particularly to drivers for horn loudspeakers.

Horn loudspeakers are in commercial use and widely discussed in scientific literature. Such loudspeakers consist of an acoustical driver and a horn which flares outwardly from a throat of restricted cross section to a mouth. The driver for such loudspeakers generally utilizes a vibratile diaphragm which is acoustically coupled to the throat of the horn, and all differences in path lengths from the diaphragm to the throat of the horn should be less than a quarter wavelength to eliminate destructive interference in the path between the diaphragm and the throat of the horn. It is also desirable that the path length from all portions of the diaphragm to the throat of the horn be the same in order to produce sound waves of the same phase at the throat. Harry F. Olson in the book *Acoustical Engineering*, D. Van Nostrand Company, Inc., 1957, at page 242 describes four different types of drivers for coupling to a small throat horn.

Commercial practice often utilizes a concave vibrative diaphragm, such as disclosed in U.S. Pat. No. 2,037,187 of Edward C. Wente in which a plurality of different areas of the diaphragm are coupled by straight paths to the throat of the horn, the path lengths being approximately the same due to the curvature of the diaphragm. Another commercial type of driver for small throat horns uses a convex diaphragm in which the center of the diaphragm and the perimeter are coupled to the throat of the horn, but large portions of the diaphragm are shielded from the throat of the horn. U.S. Pat. No. 3,016,430 of Louis S. Hoodwin is an example of a horn of this type.

Another driver construction for a small throat horn known to the prior art is disclosed in U.S. Pat. No. 3,454,729 of Seebinger in which only the peripheral ring of the convex diaphragm is coupled to the throat of the horn, the remaining portions of the diaphragm being covered by a loading plate. Also, the German Pat. No. 939,879 of Graul discloses a driver coupled to the throat of a horn in which relatively short radial segments are coupled through straight channels to the throat, other portions of the diaphragm being shielded from the throat. It is an object of the present invention to provide a horn loudspeaker which utilizes a convex diaphragm coupled to a small throat in which a larger portion of the diaphragm is directly coupled to the throat.

It is also an object of the present invention to provide a driver for a horn loudspeaker with a small throat in which the sound paths from a convex diaphragm may be readily and inexpensively fabricated. Specifically, the sound paths from the convex diaphragm extend through a diaphragm cover plate through channels which are straight and parallel to the axis of symmetry of the dome of the convex diaphragm. As a result, the cover plate may be readily fabricated, such as by molding. This construction has the advantage of low cost and is susceptible to mass production.

Horn type loudspeakers are generally designed to produce significant acoustical power, and occasionally the diaphragms of such loudspeakers are damaged and must be replaced. It is desirable that horn loudspeakers be designed to permit replacement of diaphragms in the field, even though the diaphragm must be aligned with the magnetic gap of the magnetic structure of the loudspeaker. It is an object of the present invention to provide a diaphram assembly for a horn type loudspeaker which may readily be replaced and which is not unduly costly.

These and other objects of the present invention will be readily appreciated from a further consideration of the specification, particularly in light of the accompanying drawings, in which.

Figure 1:
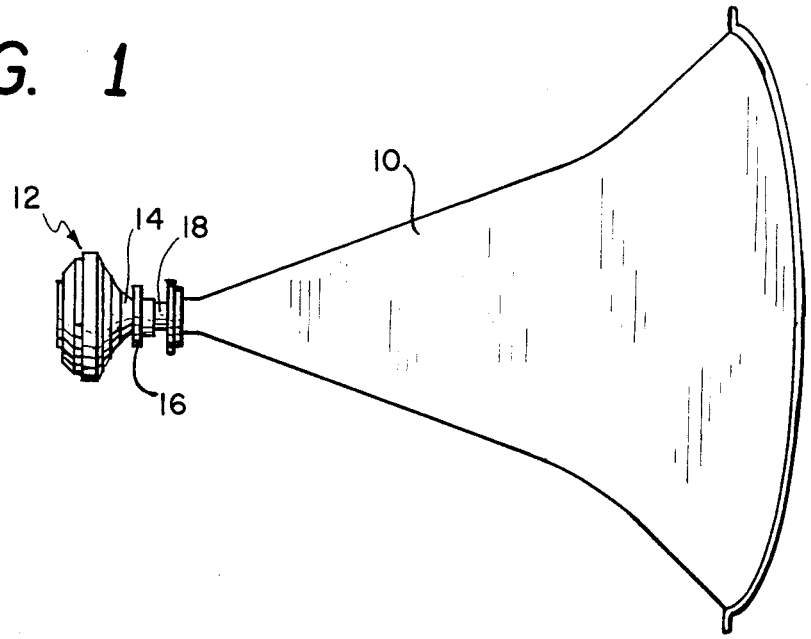
FIG. 1 is an elevational view of a loudspeaker having a horn and driver constructed according to the teachings of the present invention.

As illustrated in FIG. 1, a loudspeaker constructed according to the present invention has a horn 10 and a driver 12. The horn 10 may be of any conventional construction, and in the illustration, is constructed according to the teachings of U.S. Pat. No. 4,071,112 of D. Broadus Keele, Jr., entitled HORN LOUDSPEAKER.

The driver 12 is provided with a front cover 14 which has an outwardly extending tubular connector 16 which connects the driver 12 to the horn through a tubular coupler 18. The connector 16 of the driver and the coupler 18 permit the driver to be utilized with horns of different constructions and having different throat sizes. The throat of the horn is located within the tubular connector 16 of the driver 12.

Figure 2:
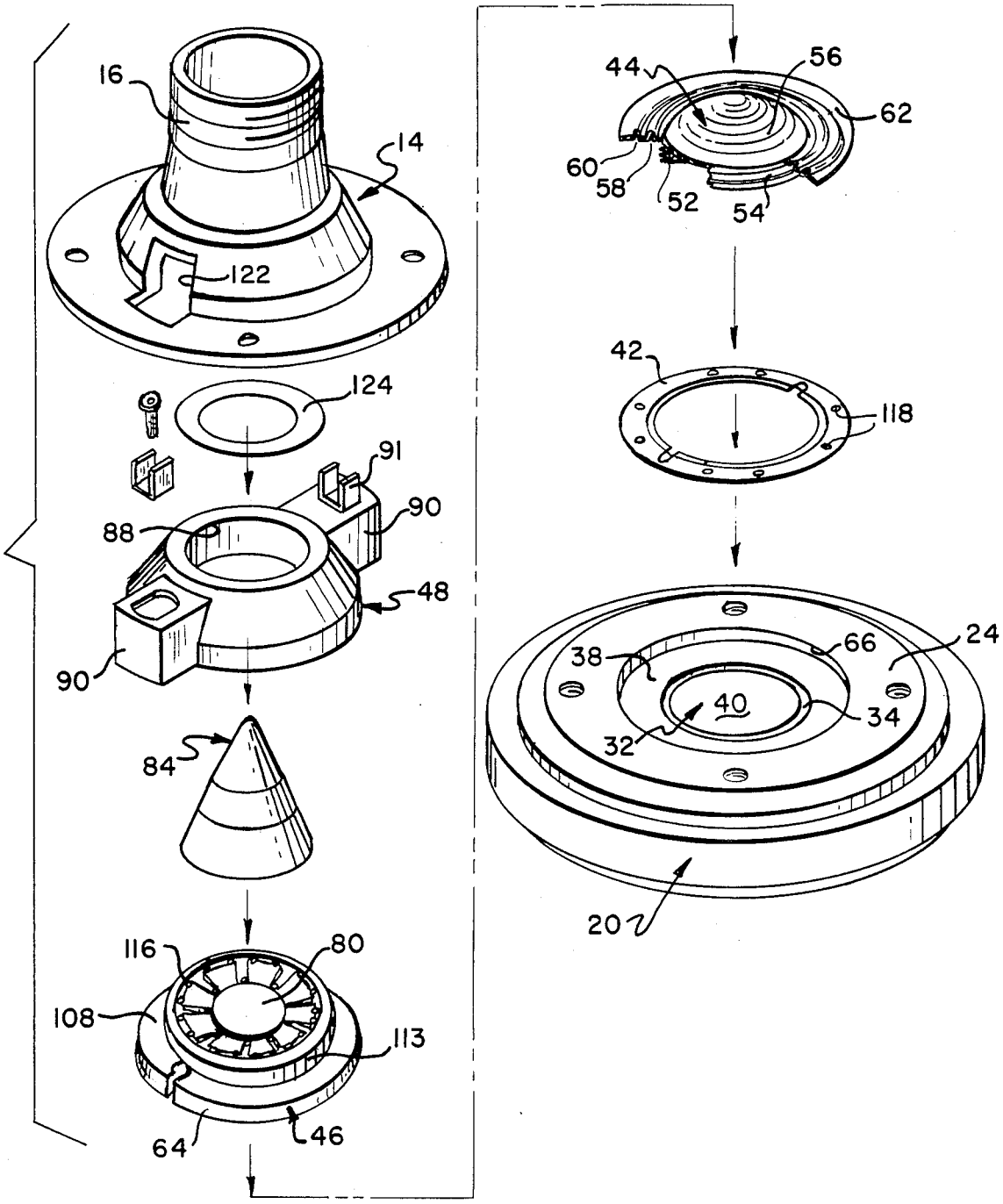
FIG. 2 is an exploded view of the driver of the loudspeaker of FIG. 1.
Figure 3:
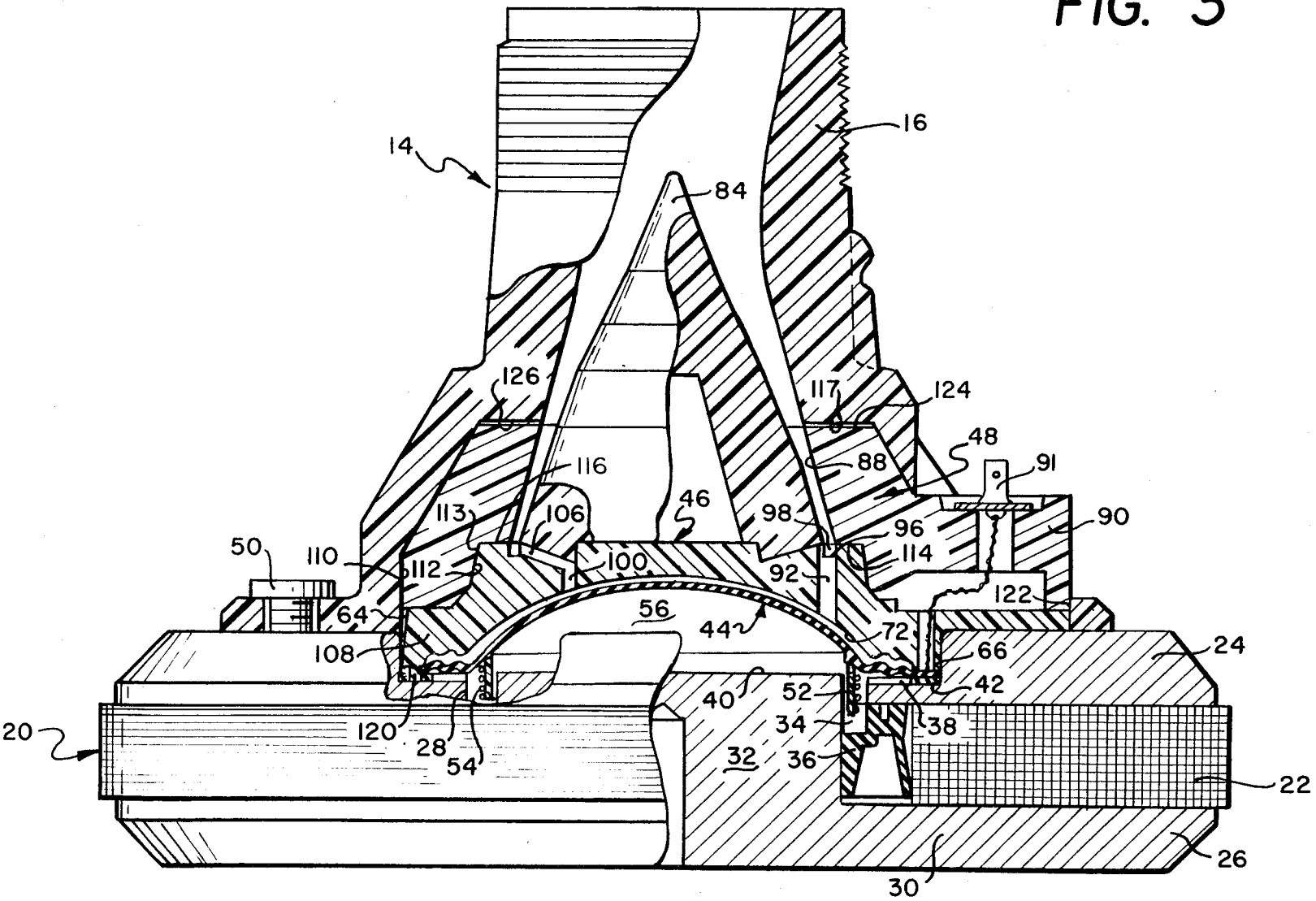
FIG. 3 is a sectional view of the driver of the loudspeaker shown in FIG. 1 taken along the line 3—3 of FIG. 4.
Figure 4:
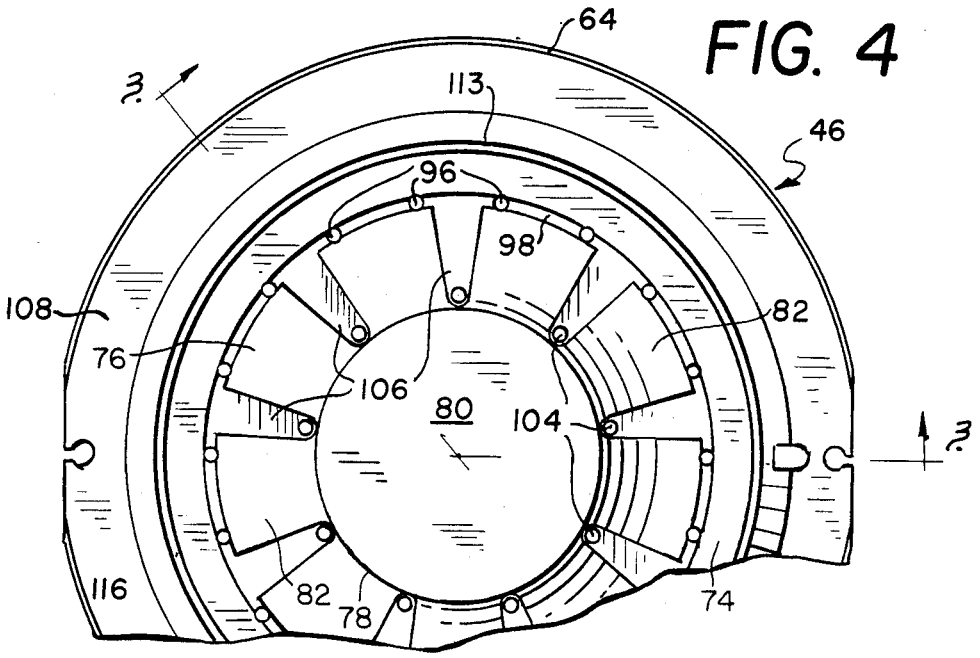
FIG. 4 is a fragmentary top elevational view of the diaphragm plate shown in FIG. 2.

The driver is best illustrated in FIGS. 2 and 3, and has a magnetic base 20 with a flat circular magnet 22 mounted between an upper circular pole piece 24 and a lower circular pole piece 26. The upper pole piece 24 is in the form of a flat ring and terminates in a cylindrical inner surface 28. The lower pole piece 26 has a flat disc portion 30 which abuts the lower surface of the magnet 22, and an upwardly extending cylindrical stub 32 with an outer surface confronting and spaced from the cylindrical surface 28 of the upper pole piece 24, thus forming a magnetic cylindrical gap 34. A nonmagnetic spacer 36 is disposed between the magnet 22 and the stub 32, and the spacer 36 establishes the proper spacial relationship between the pole pieces 24 and 26 and the magnet 22 to assure proper location of the magnetic gap 34.

The upper pole piece 24 has a cylindrical recess 38 extending from the cylindrical surface 28, the recess 38 being disposed on the same plane as the upper surface 40 of the stub 32. A flat ring spacer 42 is disposed on the cylindrical recess 38, and a diaphragm assembly 44 is mounted between the spacer ring 42 and a cover plate 46. The cover plate 46 is secured in position by a plug base 48 mounted snugly between the cover plate 46 and the front cover 14, the front cover 14 being secured to the upper pole piece 24 by means of bolts 50.

The diaphragm assembly 44 has a hollow cylindrical sleeve 52 of electrical insulating material which serves as a coil form for a voice coil 54 helically wound about the exterior surface of the sleeve at one end thereof. The other end of the sleeve 52 carries a dome shaped member 56 of rigid material. A compliant surround 58 is mounted on the exterior surface of the sleeve 52 at the interface with the dome 56, and the surround 58 is provided with convolutions 60 in the form of rings between the sleeve 52 and a flat perimeter portion 62.

The cover plate 46 has a cylindrical outer wall 64 which is disposed within the recess 38 of the magnetic base 20, and abuts the recess wall 66. On one side of the cover plate 46, a recess 68 extends inwardly from a flat surface 70 disposed normal to the axis of the cylindrical wall 64. The recess 68 forms a part spherical surface 72 which has the contour of the dome 56 of the diaphragm assembly 44, and is spaced from the surface of the dome to permit movement of the dome surface with respect to the cover plate 46. The cover plate 46 has a second flat surface 74 on the opposite side thereof and parallel to the surface 70, and the surface 74 is provided with a circular groove 76 coaxial with the axis of symmetry of the recess 68. The groove 76 forms a cylindrical wall 78 coaxial with the axes of symmetry of the surface 72, the wall 78 forming a hub 80. The groove 76 has a conical surface 82 extending from the cylindrical surface 78 to the plane of the flat surface 74. A cone shaped plug 84 is provided with a base surface 86 which matches and mates with the conical surface 82 and cylindrical wall 78, to mount on the hub 80. The plug 84 is tapered and extends from the hub 80 through an internal channel or passageway formed by a conical surface 88 in the plug base 48, thus forming an opening between the plug 84 and the surface 88 for transmittal of sound.

The plug base 48 is also provided with wings 90 which carry electrical terminals 91 which are electrically connected to the voice coil 54 on the diaphragm. In a commercial construction, the spacer ring 42, diaphragm assembly 44, cover plate 46, and its attached plug 84, and the plug base 48 are assembled in a subassembly for installation as a unit on the magnetic base 20. The subassembly is anchored in place by means of bolts 50 securing the front cover to the magnetic base.

Figure 5:
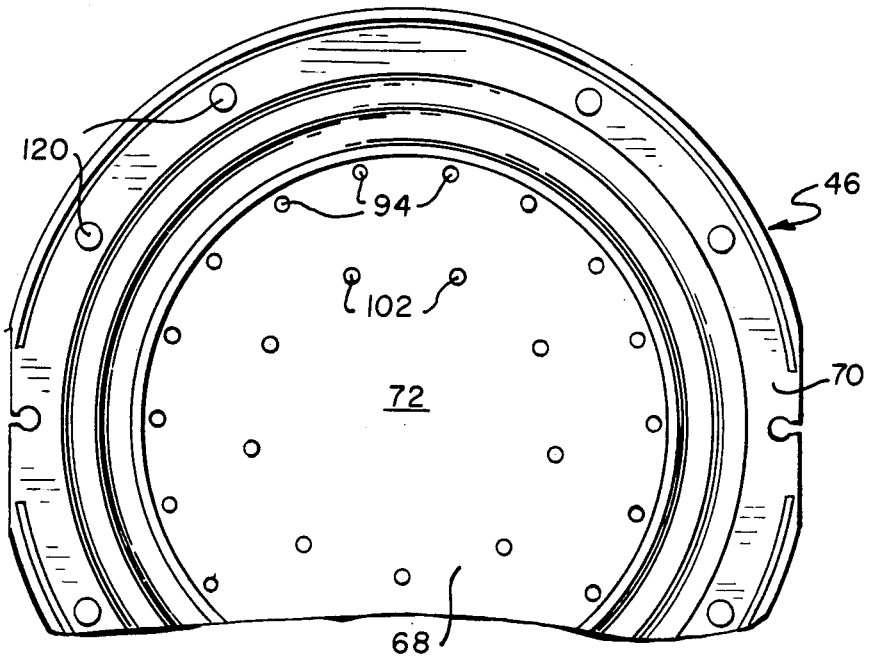
FIG. 5 is a fragmentary bottom view of the diaphragm plate shown in FIGS. 2 and 4.

FIG. 3 illustrates a straight channel 92 which extends perpendicular to the surfaces 70 and 74 from an aperture 94 in the surface 72 of the recess 68 to an opening 96 communicating with a circular groove 98 in the surface 74. The groove 98 extends about the perimeter of the plug 84. As illustrated in FIG. 5, there are a plurality of apertures 94 disposed in a circle adjacent to the perimeter of the surface 72, and each of these apertures 94 communicates with a straight channel 92 extending between the groove 98 and the surface 72 perpendicular to the surface 70 and 74. The apertures 94 are spaced by equal distances, and the ring of apertures 94 is substantially coaxial with the cylindrical gap 34.

Figure 6:
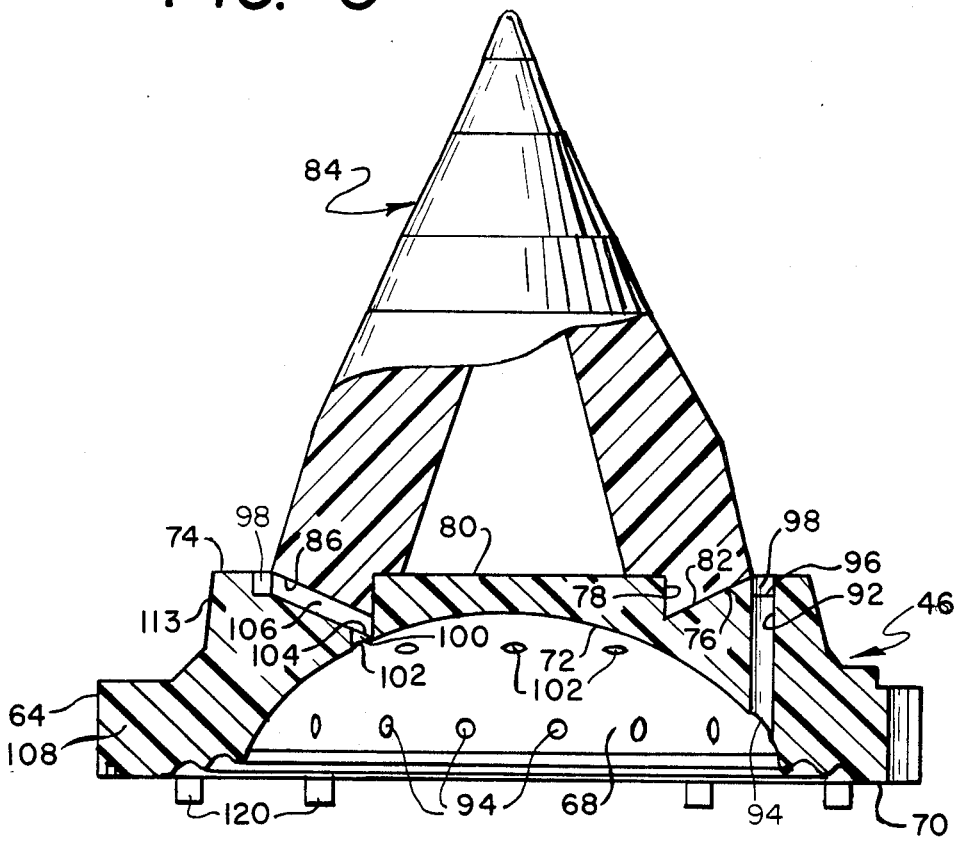
FIG. 6 is an enlarged sectional view of the diaphragm cover plate and plug as illustrated in FIGS. 2 and 3.

FIGS. 3 and 6 also illustrate a second channel 100 which extends from a second aperture 102 in the surface 72 to a second opening 104 in a groove 106 which extends from the groove 98 radially along the conical surface 82 to the cylindrical wall 78 of the hub 80. There are a plurality of apertures 102 in the surface 72, each of the apertures 102 being located on planes extending through the axis of symmetry of the surface 72 and located centrally between similar planes extending through the axis of symmetry and the apertures 94. Likewise, each of the apertures 102 communicates with a channel 100 and a groove 106 which extends to the groove 98 in the surface 74. It will be noted that the channels 92 and 100 are straight, and perpendicular to the surfaces 70 and 74, thereby making the cover plate 46 readily fabricated by plastic molding and the like. Likewise, the grooves 106 are disposed in a conical surface 82, further facilitating fabrication of the cover plate.

It will be noted that the cover plate 46 is provided with an outwardly extending flat flange 108, and this flange 108 extends to a cylindrical inner surface 110 of the front cover 14. The plug base 48 is provided with a cylindrical recess 112 which abuts the cylindrical outer wall 113 of the cover plate 46 and forms an acoustical seal therewith. The plug base 48 also has a circular shoulder 114 which abuts and forms an acoustical seal with a rim 116 which extends inwardly of the cover plate 46 from the outer wall 113 thereof. The conical tapered surface 88 extends from the circular shoulder 114 to a circular end surface 117, thus forming an anular expanding path for sound waves reaching the groove 98.

It is thus clear that the narrowest portion of the sound path from the diaphragm assembly 44 is at the groove 98, and this is the throat of the horn construction.

The spacer ring 42 is provided with a number of apertures 118, and the underside of the flange 108 of the cover plate 46 is provided with pegs 120 which mate and are accommodated by the apertures 118 of the spacer ring. The plug 84 is cemented on the hub 80, and the plug base 48 is cemented on the flange 108 and the cylindrical wall 64 of the cover plate 46. Hence, these elements form a separate subassembly.

The front cover 14 is provided with a pair of openings 122 which accommodate the wings 90 of the plug base 48. The diaphragm subassembly, including the horn throat, may be removed as a unit from a completed horn by removing the bolts 50 to release the front cover 14 from the magnetic base 20, and a replacement diaphragm assembly and throat may be reinserted into the horn. An acoustic sealing ring 124 is disposed between the circular end surface 117 of the plug base 48 and a circular shoulder 126 on the inner surface of the tubular connector 16 of the front cover 14 to provide an acoustical seal between the diaphragm subassembly and the front cover.

Sound waves generated by the moving dome 56 of the diaphragm assembly 44 travel through the two groups of sound paths provided by the channels 92 and the combination of channel 100 and groove 106 to the circular groove 98. Even though only straight channels are employed, the length of the paths from the apertures 102 to the circular groove 98 are the same as the length of the sound paths from the apertures 94 to the circular groove 98. Hence, sound entering the horn at the throat from different portions of the diaphragm is in phase, and interference is avoided. Further, a defective diaphragm may be replaced in combination with the cover plate 46, plug base 48, spacer ring 42, and plug 84, thus assuring compatability of the new diaphragm assembly in the horn.

A further advantage of this construction is that the critical spacing between the diaphragm dome 56 and the surface 68 of the cover plate 46 is determined entirely by the shape of the diaphragm and cover plate without reference to a second mounting surface, such as the top surface of the pole piece.

Those skilled in the art will devise modifications and uses beyond those here set forth. It is therefore intended that the scope of the present invention be not limited by the foregoing specification, but rather by the appended claims.

The invention claimed is:

1. A driver for a loudspeaker comprising, in combination, a base, a diaphragm mounted on the base for vibratile motion with respect to the base, said diaphragm having a dome symmetrical about a central axis and having a periphery extending about the dome, a plate mounted on the base having a recess extending therein and forming a surface symmetrical about a central axis coincident with the central axis of the diaphragm, said plate being acoustically sealed to the base about the diaphragm, said diaphragm and plate forming a cavity between the surface of the recess and the diaphragm, said plate having a plurality of channels extending therethrough and communicating with the cavity, a member mounted on the base having a passageway extending therethrough from the base, the plate being disposed within said passageway and tapering inwardly from the base, the channels of the plate communicating with the passageway of the member, a plug disposed within the passageway of the member having a surface at one end mating with and abutting a surface of the plate, said plug extending from the plate and tapering inwardly from the plate, said plug being spaced from the member forming an opening between the plug and the member for transmitting sound, wherein the plate is provided with a first aperture located on the surface of the recess adjacent to the periphery of the dome of the diaphragm, said plate having a first channel extending from the first aperture through the plate along an axis parallel to the axis of symmetry of the recess to a first opening communicating with the said channel, said plate having a second aperture located on the surface of the recess closer to the axis of symmetry of the recess than the first aperture, said plate having a second channel extending from the second aperture through the plate along an axis parallel to the axis of symmetry of the recess to a second opening, a third channel extending from the second opening of the plate along the abutting surfaces of the plug and plate to the perimeter of the plug, said third channel communicating with the sound channel.

2. A driver for a loudspeaker comprising the combination of claim 1 wherein the plate is provided with a plurality of first channels, each first channel extending between a first aperture and a first opening, said plate being provided with an equal plurality of second channels, each second channel extending between a second aperture and a second opening, the first aperture being disposed in a first circular configuration and spaced from each other by equal increments, the second aperture being disposed in a second circular configuration and spaced by equal increments.

3. A driver for a loudspeaker comprising the combination of claim 2 wherein the plate is provided with a circular groove extending about the plug, the first opening of each of the first channels being located in said groove, and each of the third channels communicating between the second opening of one of the second channels and said groove.

4. A driver for a loudspeaker comprising the combination of claim 3 wherein the plate is provided with an inwardly tapering conical surface coaxial with the axis of symmetry of the recess, said conical surface extending from the circular groove to the second openings of the second channels, said conical surface having a plurality of second linear grooves, each of said second linear grooves extending radially with respect to said conical surface from one of the second openings to the circular groove.

5. A driver for a loudspeaker comprising the combination of claim 4 wherein the lengths of the sound paths from the dome of the diaphragm though the first apertures to the first circular groove are the same as the lengths of the sound paths from the dome of the diaphragm through the second apertures to the first circular groove.

6. A subassembly for a horn loudspeaker comprising, in combination, a plate having parallel opposite flat sides and a recess extending therein from one side, said recess being symmetrical about an axis normal to the flat sides, said recess having a plurality of equally spaced first apertures located in a circle coaxial with the axis of symmetry of the recess and disposed adjacent to the perimeter of the recess, each of said first apertures communicating with a first channel extending parallel to the axis of symmetry to an opening at the other flat side of the plate, and said plate having a circular groove extending therein from the other flat side, the first opening of each of the first channels being located in said circular groove, said recess having a plurality of equally spaced second apertures equal in number to the first apertures and located in a circle closer to the axis of symmetry than the first apertures and coaxial with the axis of symmetry of the recess, a second channel extending from each of the second apertures along an axis parallel to the axis of symmetry of the recess through the plate to a second opening, a plug having a circular surface mounted coaxially with the axis of symmetry of the recess on the other side of the plate, the circular surface of the plug having a perimeter disposed inwardly of the circular groove in the other side of the plate and the plug tapering inwardly from the circular surface thereof, the other side of the plate being provided with a plurality of grooves, each of said grooves extending in a plane extending through the axis of symmetry of the recess of the plate from the opening of one of the second channels to the circular groove, a vibratile diaphragm mounted on the one side of the plate, said diaphragm having a symmetrical dome disposed within the recess and coaxial with and spaced from the surface of the recess, the first and second apertures confronting the dome.

7. A subassembly for a horn loudspeaker comprising claim 6 in combination with a plug base having a first and a second side and a channel with a circular cross-section extending therethrough from the first to the second side, said plug base being mounted on the plate and the channel thereof confronting the circular groove of the plate and tapering inwardly from said groove.

8. A subassembly for a horn loudspeaker comprising the combination of claim 7 wherein the plug base is provided with a wing extending outwardly therefrom, in combination with an electrical connector mounted on the wing, a cylindrical voice coil mounted on the diaphragm and depending coaxially from the dome, one end of said voice coil being electrically connected to the electrical connector.

9. A subassembly for a horn loudspeaker comprising the combination of claim 8 in combination with a cover having a flat end surface and an opposite end surface, a passageway extending from the flat end surface to the opposite end surface, said cover having an opening extending between the passageway and the exterior thereof, the plug base, plate and plug being disposed within the passageway, the wing of the plug base extending through the opening in the cover exposing the electrical connector.

10. A horn loudspeaker comprising the combination of claim 9 in combination with a horn mounted on the cover, said horn having a channel extending from one end of the horn to the opposite end of the horn and increasing in cross section from the one end to the opposite end, the channel at the one end of the horn being acoustically coupled to the passageway of the cover.

* * * * *